United States Patent [19]

Dennison

[11] Patent Number: 4,953,755

[45] Date of Patent: Sep. 4, 1990

[54] AUTOMATED THERMOPLASTIC DISPENSING DEVICE

[75] Inventor: Richard L. Dennison, Burnsville, Minn.

[73] Assignee: Minnesota Mining and Manufacturing Company, St. Paul, Minn.

[21] Appl. No.: 252,688

[22] Filed: Oct. 3, 1988

[51] Int. Cl.[5] ..... B67D 5/62

[52] U.S. Cl. ..... 222/146.5; 222/109; 222/333

[58] Field of Search ..... 222/146.5, 146.2, 109, 222/110, 333; 219/230

[56] References Cited

U.S. PATENT DOCUMENTS

| | | | |
|---|---|---|---|
| 3,285,475 | 11/1966 | Phillips | 222/333 |
| 3,604,597 | 9/1971 | Pohl et al. | 222/146.5 |
| 3,653,552 | 4/1972 | Ast | 222/146.5 |
| 3,854,629 | 12/1974 | Blieberger | 222/333 |
| 4,457,457 | 7/1984 | Dziki | 219/230 |
| 4,552,287 | 11/1985 | Dziki | 222/146.5 |
| 4,615,469 | 10/1986 | Kishi et al. | 222/333 |
| 4,816,642 | 3/1989 | Dennison | 219/230 |

*Primary Examiner*—H. Grant Skaggs

*Attorney, Agent, or Firm*—Donald M. Sell; Walter N. Kirn; William L. Huebsch

[57] ABSTRACT

A device for dispensing molten thermoplastic material comprising a barrel member having an internal melting chamber communicating with an outlet opening through a nozzle, and a sleeve having one end secured at the barrel member and a through opening communicating with the end of the melting chamber opposite the outlet opening. The sleeve is adapted to receive a rod of solid thermoplastic material with one end portion of the rod in the melting chamber and the rod projecting through the sleeve along a predetermined path. The barrel member is heated to melt the end portion of the rod therein, and a drive adapted to be switched between a deactivated state and an activated state is provided for driving the rod of solid thermoplastic material into the melting chamber at a predetermined rate to expel molten thermoplastic material through the nozzle. Upon switching of the drive means from the activated state to the deactivated state the drive moves the rod of solid thermoplastic material a small distance out of the melting chamber to cause molten thermoplastic material in the nozzle to flow toward the melting chamber and restrict movement (i.e., dripping or stringing) of that molten thermoplastic material out of the nozzle.

1 Claim, 4 Drawing Sheets

AUTOMATED THERMOPLASTIC DISPENSING DEVICE

TECHNICAL FIELD

The present invention relates to devices for dispensing molten thermoplastic material, and in one important aspect to means in such devices for restricting molten thermoplastic material from leaking through a nozzle on such a device when it is not in use.

BACKGROUND ART

Devices are known for dispensing molten thermoplastic material that comprise a barrel member mounted on a frame and having an internal melting chamber communicating with an outlet opening through a nozzle, a sleeve having one end secured at the barrel member and a central opening communicating with the end of the melting chamber opposite the outlet opening which is adapted to receive a rod of solid thermoplastic material with one end portion of the rod in the melting chamber and the rod projecting through the sleeve along a predetermined path, and means for heating the barrel member to melt the end portion of the rod therein so that when the rod is pressed into the barrel member molten thermoplastic material will be expelled through the nozzle. U.S. Pat. Nos. 4,552,287 and 4,457,457 describe such devices. The device described in U.S. Pat. No. 4,457,457, also includes driving means in the form of an external compressed air power source adapted to be switched between activated and deactivated states for, when in the activated state, driving the rod of solid thermoplastic material into the melting chamber to expel molten thermoplastic material through the nozzle. While such devices are suitable for many purposes, they do not afford the precision needed to dispense molten thermoplastic material in many automated systems (e.g., robot operated systems) in that it is difficult to actuate the device in such a way that will produce a precise predetermined amount or rate of output from the device, and there is a tendency for some molten thermoplastic material to escape from the nozzle when the devices is not being activated to dispense material, which is undesirable or unacceptable for many automated applications.

DISCLOSURE OF INVENTION

The present invention provides a device for dispensing molten thermoplastic material which does afford the precision needed to dispense molten thermoplastic material in automated systems, can be actuated in such a way that will produce a variety of precise predetermined amounts or rates of output from the device, and which restricts molten thermoplastic material from escaping or "stringing" from the nozzle when the device is not being activated to dispense material.

According to the present invention there is provided a device for dispensing molten thermoplastic material which, like the device described above, comprises a barrel member mounted on a frame and having an internal melting chamber communicating with an outlet opening through a nozzle, a sleeve having one end secured at the barrel member and having a through opening communicating with the end of the melting chamber opposite the outlet opening, the sleeve being adapted to receive a rod of solid thermoplastic material with one end portion of the rod in the melting chamber and the rod projecting through the sleeve along a predetermined path, means for heating the barrel member to melt the end portion of the rod therein, and driving means adapted to be switched between a deactivated state and an activated state for driving the rod of solid thermoplastic material into the melting chamber so that molten thermoplastic material will be dispensed through the nozzle.

Unlike the device described above, however, in the device according to the present invention the driving means can be activated to drive the rod of solid thermoplastic material into the melting chamber at a predetermined rate to expel molten thermoplastic material through the nozzle at a predetermined rate, and includes suck back means operable upon switching of the drive means from the activated state to the deactivated state adapted for moving the rod of solid thermoplastic material a short distance out of the melting chamber to cause molten thermoplastic material in the nozzle to flow toward the melting chamber and restrict movement or dripping of that molten thermoplastic material out of the nozzle.

Preferably device is adapted to drive the rod of solid thermoplastic material into the melting chamber at any one or a plurality of different predetermined rates, and the suck back means is adapted for moving the rod of solid thermoplastic material a single predetermined distance out of the melting chamber regardless of the rate at which the rod was being driven into the melting chamber in the activated state.

Also, preferably the driving means comprises at least one drive roller which is rotatably mounted on the frame adjacent the end of the sleeve opposite the chamber with its axis transverse of the path and its periphery (which is adapted for engagement with the rod of solid thermoplastic material) positioned to afford driving engagement with the portion of the rod of solid thermoplastic material projecting along the path. A rotor in a reversible direct current motor is coupled by drive means to the drive roller, and motor control means are provided that can rotate the rotor of the motor in a forward rotational direction at different predetermined rates of speed so that through the drive roller the motor can expel molten thermoplastic material through the nozzle at different predetermined rates; and the suck back means comprises means in the motor control means for, when the motor is deactivated, sequentially, shorting electro motive forces in the motor to ground, and applying a predetermined amount of power to rotate the armature of the motor in a reverse rotational direction through a predetermined angle to move the rod of solid thermoplastic material said single predetermined distance out of the melting chamber. Such shorting of the electro motive forces in the motor is important, for if it were not done the application of a predetermined amount of power to operate the motor in the reverse direction would result in different angles of rotation of the motor armature due to the need before the rotation could begin to overcome different amounts of electro motive force remaining in the motor resulting from different rates of armature rotation prior to deactivating the motor.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
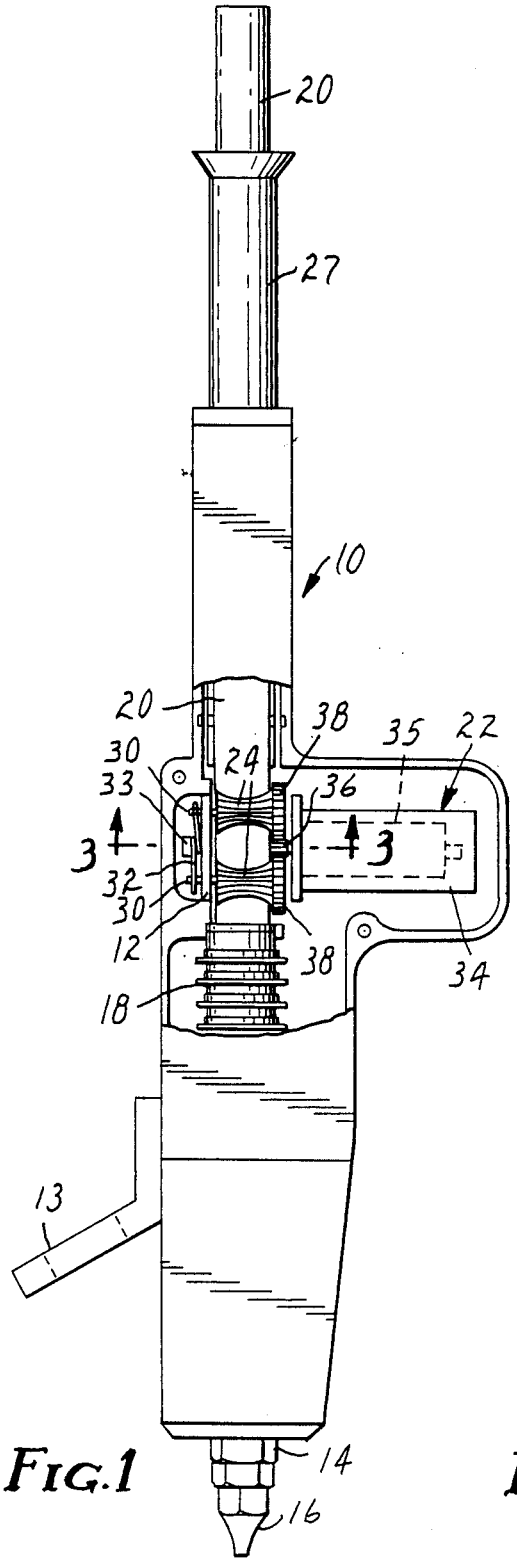
FIG. 1 is a vertical front view of a device for dispensing molten thermoplastic material according to the present invention that has parts broken away to show detail.
Figure 2:
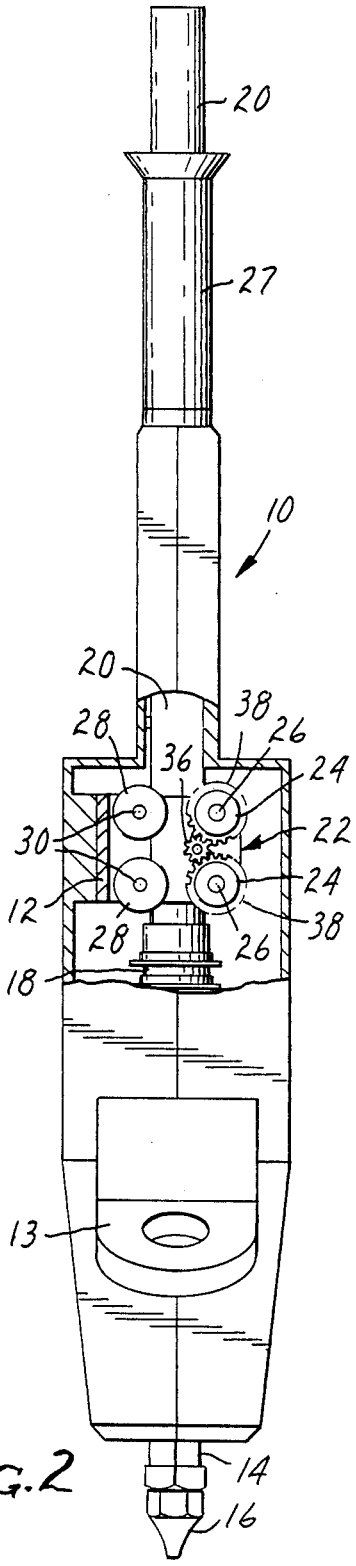
FIG. 2 is a vertical side view of the device of FIG. 1 that has parts broken away to show detail.
Figure 3:
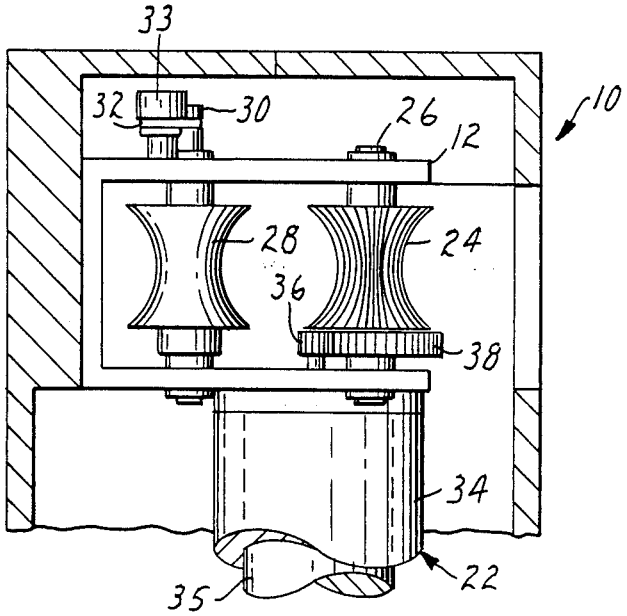
FIG. 3 is an enlarged fragmentary sectional view taken approximately along line 3—3 of FIG. 1.
Figure 4:
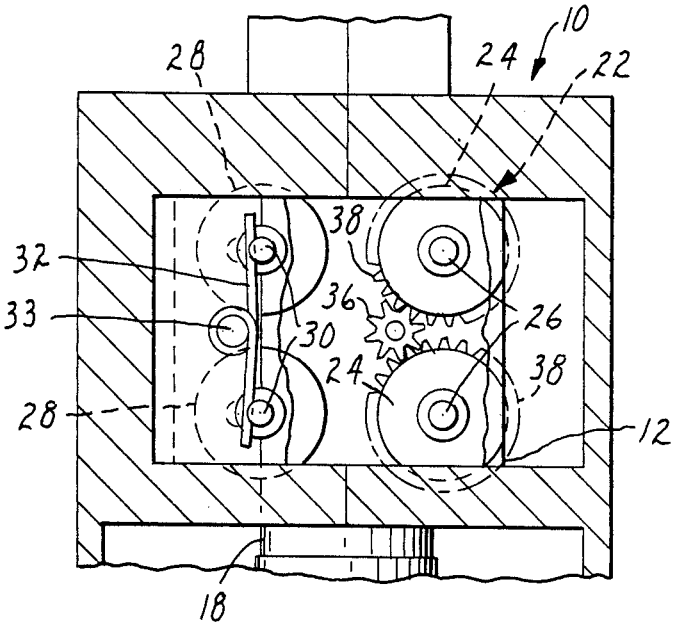
FIG. 4 is an enlarged fragmentary sectional view taken approximately along line 4—4 of FIG. 2.

Referring now to the drawing, there is shown a device for dispensing molten thermoplastic material according to the present invention generally designated by the reference numeral 10.

Generally the device 10 comprises a frame 12 adapted to be mounted by a bracket 13 on a movable support such as the arm of a robot, a barrel member 14 mounted on the frame 12 and having an internal melting chamber communicating with an outlet opening through a nozzle 16, a sleeve 18 having one end secured at the barrel member 14 and a through opening communicating with the end of the melting chamber opposite the outlet opening, the sleeve 18 being adapted to receive a cylindrical rod 20 of solid thermoplastic material with one end portion of the rod 20 in the melting chamber and the rod 20 projecting through the sleeve 18 along a predetermined path, and means for heating the barrel member 14 to melt the end portion of the rod 20 therein, all being of generally the same structure as the corresponding components of the device described in U.S. Pat. No. 4,552,287 (the content whereof is incorporated herein by reference) modified to incorporate the temperature control described in my U.S. Pat. No. 4,816,642, the content whereof is also incorporated herein by reference.

Additionally the device 10 includes novel driving means 22 adapted to be switched between a deactivated state and different forward activated states for driving the rod 20 of solid thermoplastic material into the melting chamber at different predetermined rates to expel molten thermoplastic material through the nozzle 16 at different predetermined rates, and suck back means operable upon switching of the drive means from any one of the forward activated states to the deactivated state adapted for moving the rod 20 of solid thermoplastic material a single predetermined distance out of the melting chamber to cause molten thermoplastic material in the nozzle 16 to flow toward the melting chamber and restrict movement of that molten thermoplastic material out of the nozzle 16.

The driving means comprises at least one, and as illustrated, two drive rollers 24 each having an axially ribbed concave periphery adapted for engagement with by indenting one side of the rod 20 of solid thermoplastic material and rotatably mounted about shafts 26 on the frame 12 in spaced relationship adjacent the end of the sleeve 18 opposite the chamber with its axis transverse of the path and its periphery positioned to afford driving engagement with a portion of the rod 20 of solid thermoplastic material projecting from the sleeve 18 along the path between the sleeve 18 and a guide tube 27. Each drive roller 24 is in opposed relationship to an idler roller 28 on the opposite side of the path that is similar in size and shape but has a smooth outer surface. Each idler roller 28 is rotatably mounted on a shaft 30 having ends received in slots in the frame 12. The idler rollers 28 are biased toward the drive rollers 24 by the ends of a spring 32 mounted by having a central coil of the spring 32 around a pin 33 on the frame 12 to insure good driving engagement between the drive rollers 24 and the rod 20.

Also included in the driving means is a reversible direct current motor 34 having a rotor 35, drive means in the form of a gear reduction assembly including a spur gear 36 on an output shaft driven by the rotor 35 (e.g., the 6 volt DC motor commercially designated Escap 22C11-216-5 together with the 128 to 1 reduction gear reduction assembly commercially designated Escap B24.0-128, both available from Stock Drive Products Designatronics, Inc., New Hyde Park, N.Y.) and engaged with spur gears 38 fixed at ends of the drive rollers 24 for coupling the rotor 35 to the drive rollers 24, and an electrical circuit (see FIGS. 5A and 5B) that provides motor control means for deactivating the motor 34 and for operating the motor 34 to rotate the rotor 35 in a forward rotational direction at different predetermined rates of speed so that the motor rotates the drive rollers 24 in a direction to move the rod 20 of solid thermoplastic material into the melting chamber at different predetermined rates to expel molten thermoplastic material through the nozzle 16 at different predetermined rates; and wherein the suck back means comprises means in the motor control means sequentially operated upon deactivation of the motor 34 for shorting electro motive forces in the motor 34 to ground, and for applying a predetermined amount of power to the motor 34 to rotate the rotor 35 in the motor 34 in a reverse rotational direction through a predetermined angle. Such shorting of the electro motive forces in the motor 34 to ground is important, for if it were not done the application of a predetermined amount of power to operate the motor 34 in the reverse direction would result in different angles of reverse rotation of the rotor 35 due to the need before such reverse rotation could begin to overcome different amounts of electro motive force remaining in the motor 34 resulting from different rates of forward rotor rotation prior to deactivating the motor 34. Use of such grounding, however, insures that the the rod 20 of solid thermoplastic material will be moved a single predetermined distance out of the melting chamber to both cause molten thermoplastic material in the nozzle 16 to flow toward the melting chamber and restrict movement or dripping of that molten thermoplastic material out of the nozzle 16, and to place that rod at a known location with in the melting chamber so that upon reactivation of the motor 35 to rotate the rotor 35 in the forward direction the amount of rotation required to start melted thermoplastic material flowing from the nozzle 16 will be known, which is important to place that melted thermoplastic material at a predetermined location on a substrate.

Figure 5A:
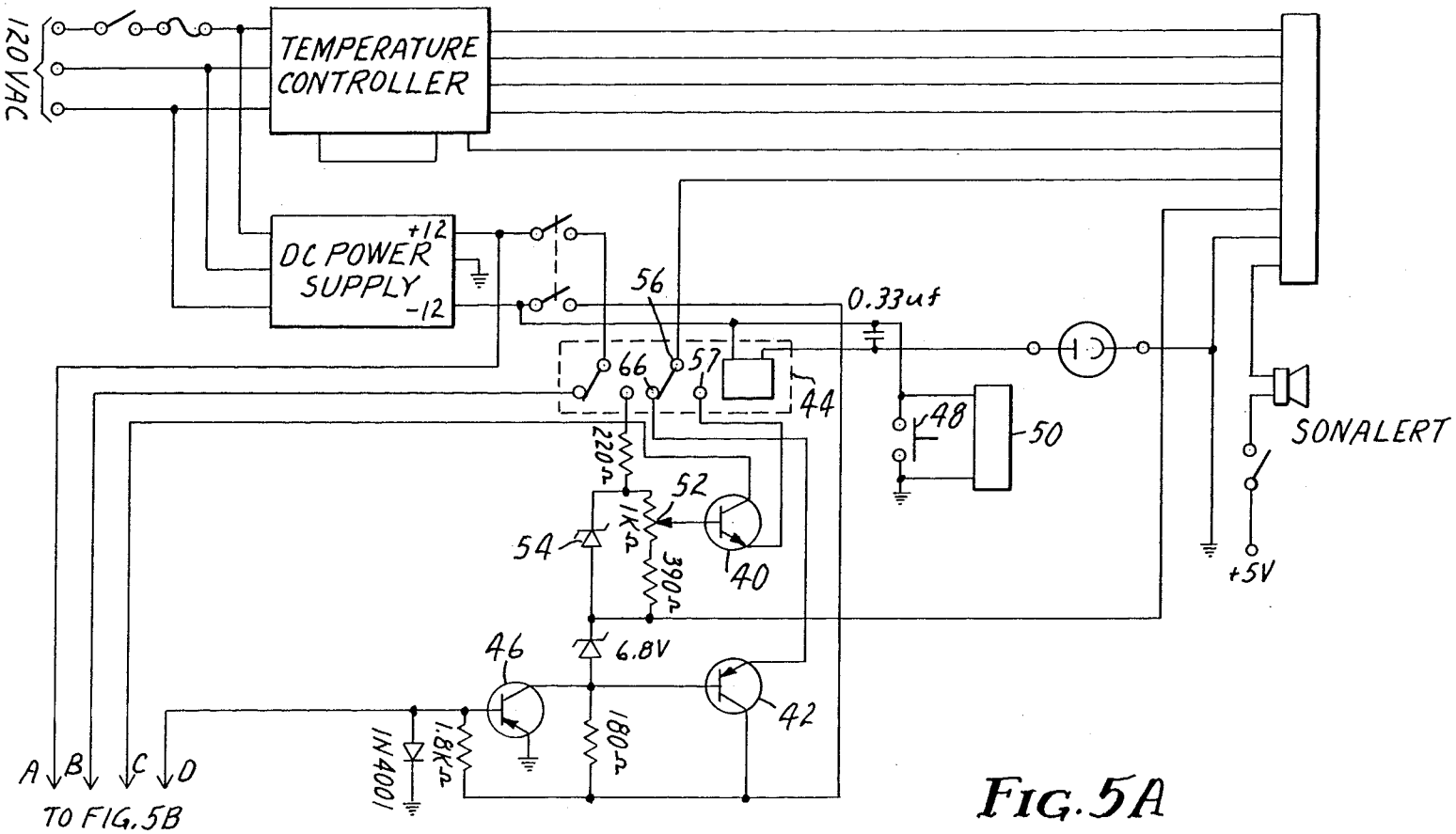
FIGS. 5A and 5B together provide a schematic view of a motor control means for the device of FIG. 1.
Figure 5B:
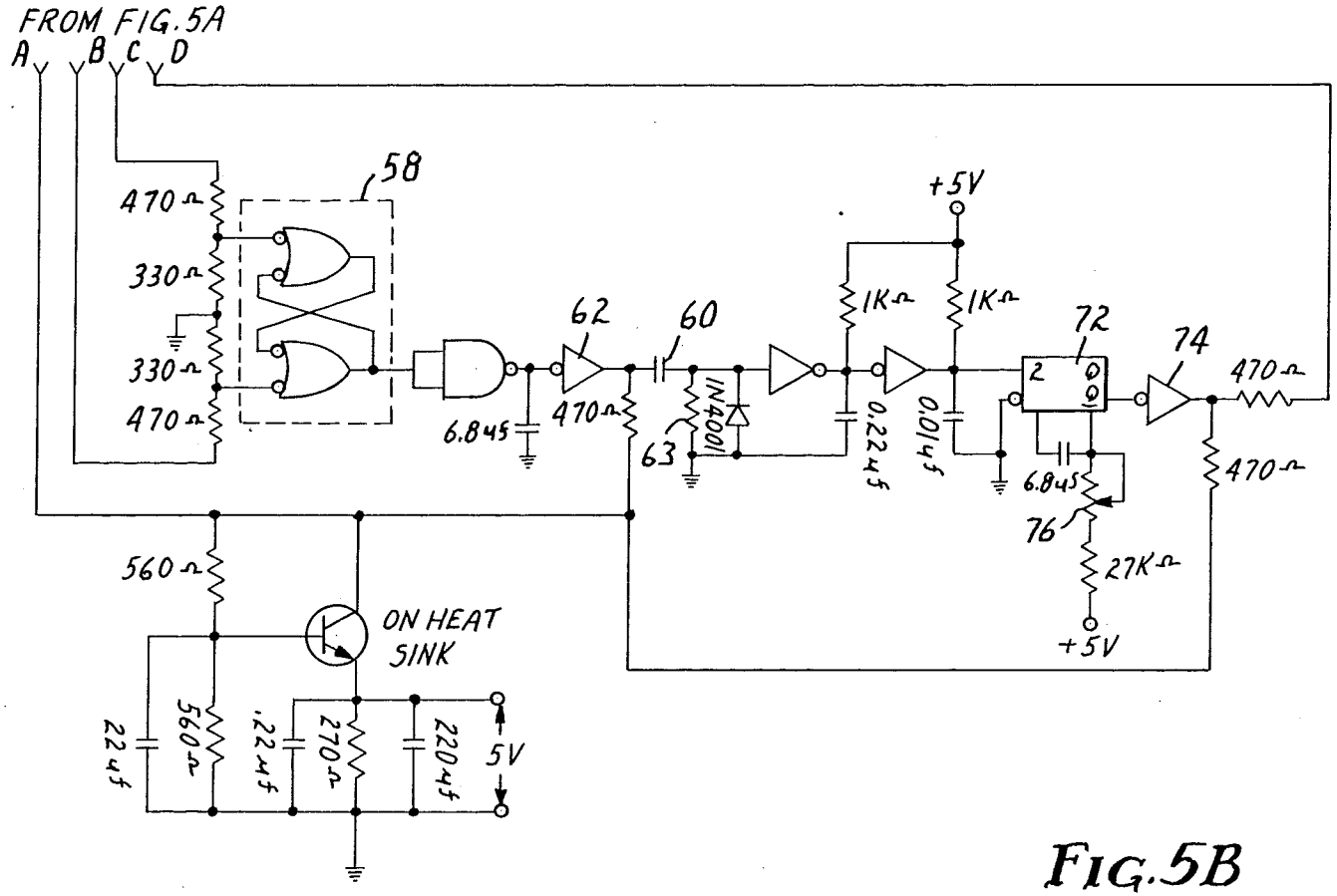

An electrical circuit that provides at least a portion of the motor control means is illustrated in FIGS. 5A and 5B. In that circuit power is directed to the motor 34 by power transistors 40 (forward rotation) and 42 (reverse rotation). Transistors 40 and 42 are connected together in a complimentary emitter follower configuration and have their emitters connected to contacts of a relay 44 such that through the relay 44 either of the transistors 40 or 42 alone may be connected to the motor 34. When the relay 44 is de-energized its contacts are position so that the reverse rotation transistor 42 is connected to the motor 34, however, a clamp transistor 46 is turned on hard, diverting to ground base drive current for the transistor 42 so that transistor 42 is turned "off" and no power is transmitted to the motor 34. The motor 34 is activated to drive the rod 20 into the chamber by energizing the relay 44 either by depressing the manual adhesive feed switch 48 or by a remote control device (such as may be incorporated in a robot) closing contacts to complete a connection through a plug 50. When the relay 44 is energized, forward rotation transistor 40 is connected to the motor 34. The magnitude of the voltage supplied to the motor 34 and the corresponding rate of armature rotation in the motor 34 is determined by the setting of a potentiometer 52 connected to the base of the forward rotation transistor 40. The maximum voltage that can be applied to the motor 34 is approximately 6 volts and is limited by a zener diode 54 connected across the base input network of the forward rotation transistor 40. Power to rotate the rotor 35 in the motor 34 in the forward direction (and thereby dispense thermoplastic material from the nozzle 16) will be continuously supplied as long as the relay 44 is energized.

The suck back means are provided in that when the relay 44 is first energized normally open contacts 56 & 57 close and set a flip-flop 58 so that pin 36 of the flip-flop 58 goes negative causing a 0.01 μf flip-flop capacitor 60 connected to the output of an inverter 62 to discharge through a 330 ohm resistor 63 and an output of the inverter 62. The flip-flop 58 remains in this state as long as the relay 44 is energized. When the relay 44 is de-energized by either breaking the connection at the manual adhesive feed switch 48 or in the remote control device connected by the plug 50) the reverse rotation transistor 42 is again connected to the motor 34, the flip-flop 58 is reset by normally closed contacts 56 and 66 causing pin 6 of the flip-flop 58 to go positive which, through the inverter 62, causes a pulse of current to flow though the 330 ohm resistor 63 (i.e., the 0.01 μf capacitor 60 and the 330 ohm resistor 63 form a differentiating network). This ultimately causes a positive pulse of about 5 μs to occur at the pin 2 input of a one-shot 72. The Q NOT output of the one-shot 72 goes negative, causing the output of an inverter 74 to go high. This, in turn, causes the input of the clamp transistor 46 to go high by approximately 0.6 volt which causes the transistor 46 to turn "off". When the transistor 46 turns "off" base-emitter current flows in the reverse rotation transistor 42 causing reverse drive voltage to be applied to the motor 34. Note that a full 6 volts of DC power is applied to the drive motor 34. The rotor 35 of the motor 34 will be driven in reverse, thus retracting (or pulling back) the adhesive rod 20 in the barrel member 14, and causing a check valve (not shown) at the nozzle 16 to close quickly, preventing dripping from the nozzle 16 for a short time and breaking the "string" of adhesive extending from the nozzle 16 that normally otherwise occurs. The reverse rotation of the rotor 35 will continue for the time setting of the one-shot 72, which time period is determined by the setting of a 500 K ohm potentiometer 76 connected between pin 15 of the one-shot 72 and a positive 5 volts power supply. The timing provided by the one-shot 72 is variable between approximately 25 micro seconds and approximately 1.6 seconds by adjusting the potentiometer 76. After the one-shot 72 runs out the system returns to its quiescent condition. The suck back of the rod 20 will not occur when the motor 34 is activated for such a short time period that back EMF in the motor 34 is not stabilized and no movement of the rotor 35 or rod 20 occurs. Rather, the rod 20 must be advanced by at least a very short amount before the suck back occurs to prevent the rod 20 from being "backed" out of the barrel member 14.

The circuit shown in FIGS. 5A and 5B does not illustrate the means described above for shorting electro motive forces in the motor 34 to ground prior to applying a predetermined amount of power to the motor 34 to rotate the rotor 35 in the motor 34 in a reverse rotational direction to provide the suck back of the rod 20. That means for shorting can be provided by incorporating an additional one-shot to control a PNP transistor across the windings of the motor 34 which, with suitable diode steering, will provide such grounding for a predetermined time.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

I claim:

1. A device for dispensing molten thermoplastic material comprising:

a frame;

a barrel member mounted on said frame and having an internal melting chamber communicating with an outlet opening through a nozzle;

a sleeve having one end secured at said barrel member and a through opening communicating with the end of said melting chamber opposite said outlet opening, said sleeve being adapted to receive a rod of solid thermoplastic material with one end portion of the rod in the melting chamber and the rod projecting through said sleeve along a predetermined path;

means for heating said barrel member to melt the end portion of the rod therein;

driving means adapted to be switched between a deactivated state and different forward activated states for driving said rod of solid thermoplastic material into said melting chamber at different predetermined rates to expel molten thermoplastic material through said nozzle at different predetermined rates, said driving means comprising at least one drive roller having an axis and a periphery adapted for engagement with said rod of solid thermoplastic material, means for rotatably mounting said drive roller on said frame adjacent the end of said sleeve opposite said chamber with said axis transverse of said path and said periphery positioned to afford driving engagement with a said rod of solid thermoplastic material projecting though said sleeve along said path, a reversible direct current motor having a rotor, drive means for coupling said rotor to said drive roller, and motor control means for deactivating said motor and for operating said motor to rotate said rotor shaft in a forward rotational direction at different predetermined rates of speed so that said motor rotates said drive roller in a direction to move said rod of solid thermoplastic material into said melting chamber at different predetermined rates to expel molten thermoplastic material through said nozzle at different predetermined rates; and suck back means operable upon switching of said drive means from any one of said forward activated states to said deactivated state adapted for moving said rod of solid thermoplastic material a single predetermined distance out of said melting chamber to cause molten thermoplastic material in said nozzle to flow toward said melting chamber and restrict movement of that molten thermoplastic material out of the nozzle, said suck back means comprising means in said motor control means sequentially operated upon deactivation of said motor for shorting electro motive forces in said motor to ground, and for applying a predetermined amount of power to said motor to rotate said rotor in said motor in a reverse rotational direction through a predetermined angle.

* * * * *